US007537526B2

(12) United States Patent
Cho

(10) Patent No.: US 7,537,526 B2
(45) Date of Patent: May 26, 2009

(54) GOLF PUTTER HAVING A FUNCTION OF PROVIDING PUTTING INFORMATION

(76) Inventor: Wook Je Cho, Sidaecore Apt. #201-1503, 879-4 Bision2-dong, Pyeongtaek-si, Gyeonggi-do (KR)

( * ) Notice: Subject to any disclaimer, the term of this patent is extended or adjusted under 35 U.S.C. 154(b) by 0 days.

(21) Appl. No.: 11/693,954

(22) Filed: Mar. 30, 2007

(65) Prior Publication Data

US 2008/0242435 A1 Oct. 2, 2008

(51) Int. Cl.
*A63B 69/36* (2006.01)

(52) U.S. Cl. ..... 473/221; 473/223

(58) Field of Classification Search ..... 473/202, 473/219, 221, 222, 223, 226, 404
See application file for complete search history.

(56) References Cited

U.S. PATENT DOCUMENTS

2006/0029916 A1* 2/2006 Boscha ..... 434/252
2006/0079342 A1* 4/2006 Koiwai ..... 473/219
2006/0166738 A1* 7/2006 Eyestone et al. ..... 463/36
2007/0265105 A1* 11/2007 Barton et al. ..... 473/220

* cited by examiner

*Primary Examiner*—Nini Legesse
(74) *Attorney, Agent, or Firm*—Kelleher IP, PLLC; Sean Liam Kelleher

(57) ABSTRACT

The present invention relates to a golf putter mainly used for a putting stoke in golf clubs. The golf putter in accordance with the present invention adds a putting information providing apparatus 4, which provides putting information to a player, to an ordinary golf putter including a head 1, a shaft 2 and a grip 3. The putting information providing apparatus 4 comprises an operation switch 41, through which a player inputs distance information from a golf ball to a hole; an LCD 46 displaying putting information; and a gradient sensor 44 providing gradient information corresponding to a tilted state when the putter is laid on a horizontal surface. The putting information providing apparatus 4 displays position information of an imaginary hole against an actual hole based on the distance information and gradient information so that the player can perform a putting stroke toward the imaginary hole.

5 Claims, 9 Drawing Sheets

GOLF PUTTER HAVING A FUNCTION OF PROVIDING PUTTING INFORMATION

BACKGROUND OF THE INVENTION

1. Field of the Invention

The present invention relates to a golf club used for a putting stoke, i.e., a golf putter and, more particularly, to a golf putter having a function of providing putting information to a player based on information on a green gradient.

2. Description of Related Art

Golf clubs are generally divided into various types such as irons, drivers, putters, etc. according to the materials and intended uses. In general, a golf player selects an appropriate golf club based on a distance from a golf ball to a golf hole or a place state where the ball is dropped.

As is well known, a putter is a club designed primarily for rolling the ball in a short distance. The putter is used mainly for putting the ball on a putting green into the hole. Stroking the putter is called a putting. The putting is significantly influenced by a surface state of the putting green and a green gradient. Especially, since the green gradient has an effect on the direction of the ball hit by the butter, the player should pay attention to the surface state of the green during play. An experienced golfer considers the green gradient carefully to putt the ball toward the hole in an appropriate direction and at an appropriate velocity according to the distance from the ball to the hole and the surface state.

In generally, the putting is a final stroke for depositing the ball into the hole on the green in order to finish one hole, which is directly related to a game score. If the player performs the putting stroke very accurately, the total stroke number is expected to decrease. However, the process of determining a putting line according to the green information, especially, on the green gradient is generally based on the skill and cognitive ability that the golfer has, it is very difficult to increase the accuracy. Such difficulties occur in skilled golfers as well beginners. If there is a means of providing the green information to the golfer appropriately, it is possible to effectively improve the putting performance of golfers.

SUMMARY OF THE INVENTION

The present invention has been contrived taking the above-described circumstances into consideration, and an object of the present invention is to provide a golf putter that determines the state of a putting green and provides putting information based on the state of the putting green.

To accomplish the above object, there is provided a golf putter including a head, a shaft and a grip and used for a putting stroke, the golf putter having a function of providing putting information in accordance with a first aspect of the present invention comprising: a putting information providing apparatus fixedly established at a predetermined position of the shaft; and a battery receptacle inserted and fixed to one end of the shaft, the putting information providing apparatus and the battery receptacle being electrically connected to each other through a wire, wherein the putting information providing apparatus comprises: a operation switch, through which a player inputs distance information from a golf ball to a hole; a gradient sensor providing gradient information corresponding to a tilted state when the putter is laid on a horizontal surface; a data storage means storing position information on an imaginary hole against an actual hole based on the distance information and the gradient information; a display means displaying the position information of the imaginary hole; and a control means reading the position information of the imaginary hole from the data storage means based on the distance information and the gradient information and outputting the position information of the imaginary hole through the display means.

Moreover, the putting information includes distance information between the actual hole and the imaginary hole.

Furthermore, the putting information includes angle information on an ideal putting line connecting a straight line between the ball and the imaginary hole against a straight line between the ball and the actual hole.

In addition, the putting information providing apparatus further comprises a solar cell providing operational power to the apparatus using input light.

To accomplish the above object, there is provided a golf putter including a head, a shaft and a grip and used for a putting stroke, the golf putter having a function of providing putting information in accordance with a second aspect of the present invention comprising: a putting information providing apparatus fixedly established at a predetermined position of the shaft; and a battery receptacle inserted and fixed to one end of the shaft, the putting information providing apparatus and the battery receptacle being electrically connected to each other through a wire, wherein the putting information providing apparatus includes: a lower cover and an upper cover made of a transparent material, the lower and upper cover forming a cylindrical shape when being connected to each other, wherein a substrate including an LCD, through which putting information is displayed, and an operation switch, through which distance information from a golf ball to a hole is input, is established on the upper portion of the lower cover; and wherein a circuit means providing putting information based on green gradient information and distance information from the ball to an actual hole is arranged on the rear portion of the substrate.

Moreover, a plurality of projections is formed on both ends of the upper cover.

Furthermore, the circuit means comprises: a gradient sensor providing gradient information corresponding to a tilted state when the putter is laid on a horizontal surface; a data storage means storing position information on an imaginary hole against an actual hole based on the distance information and the gradient information; and a control means reading the position information of the imaginary hole from the data storage means based on the distance information and the gradient information and outputting the position information of the imaginary hole through a display means.

In addition, the putting information includes distance information between the actual hole and the imaginary hole.

Moreover, the putting information includes angle information on an ideal putting line connecting a straight line between the ball and the imaginary hole against a straight line between the ball and the actual hole.

Furthermore, the putting information providing apparatus further comprises a solar cell providing operational power to the apparatus using input light.

BRIEF DESCRIPTION OF THE DRAWINGS

The above and other features of the present invention will be described with reference to certain exemplary embodiments thereof illustrated the attached drawings in which.

DETAILED DESCRIPTION OF THE INVENTION

Hereinafter, preferred embodiments in accordance with the present invention will be described with reference to the accompanying drawings. The preferred embodiments are provided so that those skilled in the art can sufficiently understand the present invention, but can be modified in various forms and the scope of the present invention is not limited to the preferred embodiments.

First, a basic concept of the present invention will be described with reference to FIG. 1.

Figure 1:
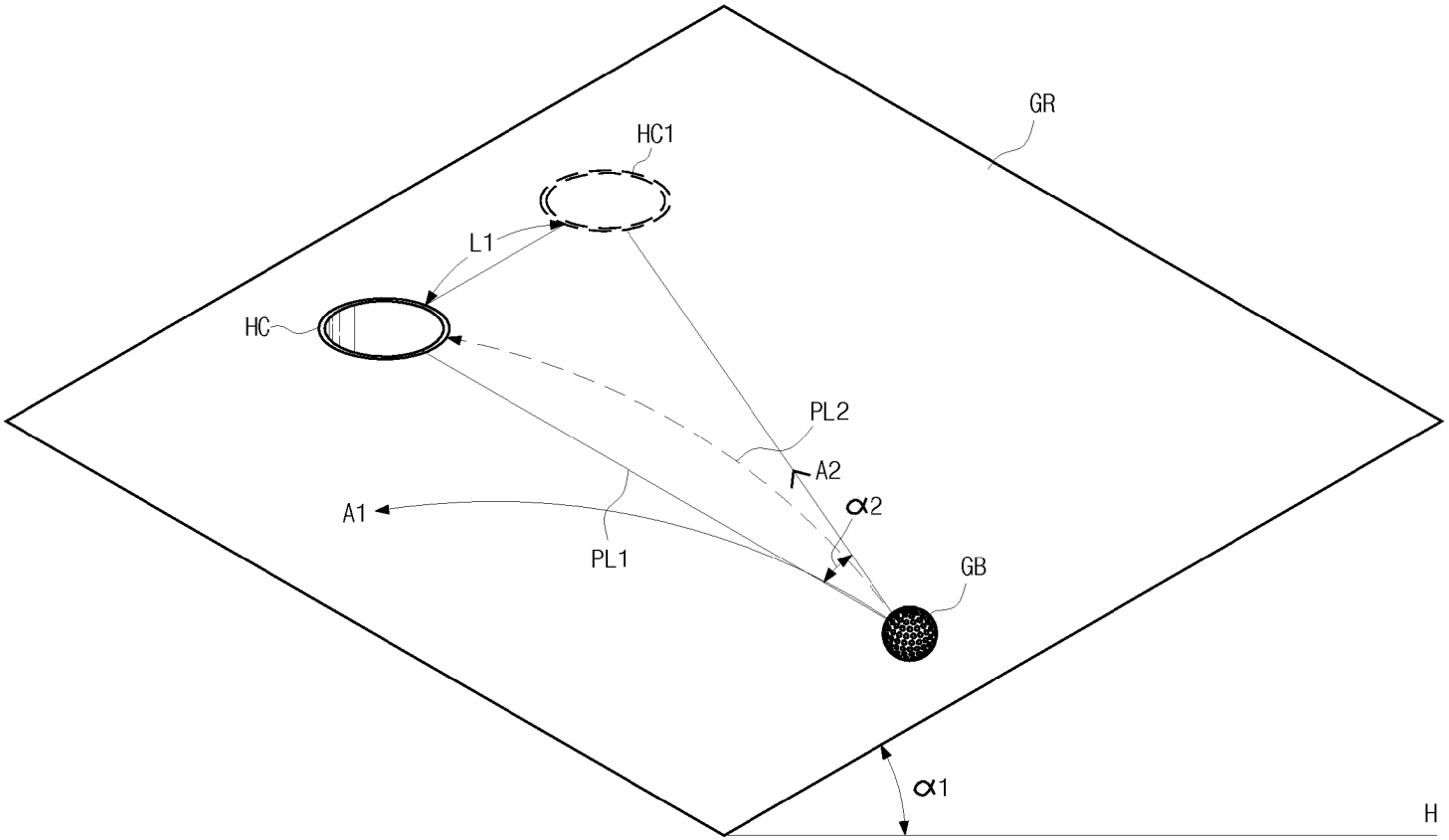
FIG. 1 is a conceptual diagram illustrating a basic concept of the present invention.

FIG. 1 is a conceptual diagram depicting that a top surface of a green GR is tilted at a predetermined angle $\alpha 1$ based on a horizontal line H. Reference number GB denotes a golf ball and HC denotes a hole cup (hole).

Usually, the putter is used to putt the golf ball into the hole. The putter has a face centerline formed on a putting surface thereof. Accordingly, the ball hit by the face centerline at impact of the putter moves in the perpendicular direction to the putting surface. The player would read a distance from the ball GB to the hole HC and a gradient $\alpha 1$ of the green GR to determine a putting line prior to putting the ball GB. The putting line is the estimated path that the ball GB on the green GR will travel from the putter to the hole HC. If the putting line is determined, the player performs a putting stroke along the corresponding putting line with an appropriate power to the extent that the ball GB reaches the hole HC.

If the player selects a straight line PL1 from the ball GB to the hole HC as the putting line, the ball GB hit by the putter does not go straight toward the hole HC but goes toward A1. The reason for this is because the green GR is tilted at an angle of $\alpha 1$ to the horizontal line.

Accordingly, in order to get the ball GB into the hole HC accurately, the player should estimate an ideal putting line PL2 along which the ball GB goes toward the hole HC and perform a putting stroke in the corresponding direction A2. However, such an ideal putting line PL2 is varied according to the gradient $\alpha 1$ of the green GR and the distance from the ball GB to the hole HC. Accordingly, it is difficult for the player to estimate the ideal putting line PL2 accurately only based on his/her visual and experiential judgement.

The present invention is to provide putting information corresponding to the ideal putting line PL2 to the player based on distance information from the ball GB to the hole HC and the gradient $\alpha 1$ of the green GR. For this purpose, the present invention generates an imaginary hole HC1 against the actual hole HC, that is, an imaginary hole HC1 positioned on the ideal putting line PL2 and corresponding to the distance between the ball GB and the actual hole HC, and provides the position information on the imaginary hole HC1 to the player as the putting information. Here, as the putting information, distance information L1 between the actual hole HC and the imaginary hole HC1, and angle information $\alpha 2$ of the ideal putting line PL2 against the straight line PL1 between the actual hole HC and the ball GB can be used.

Figure 2:
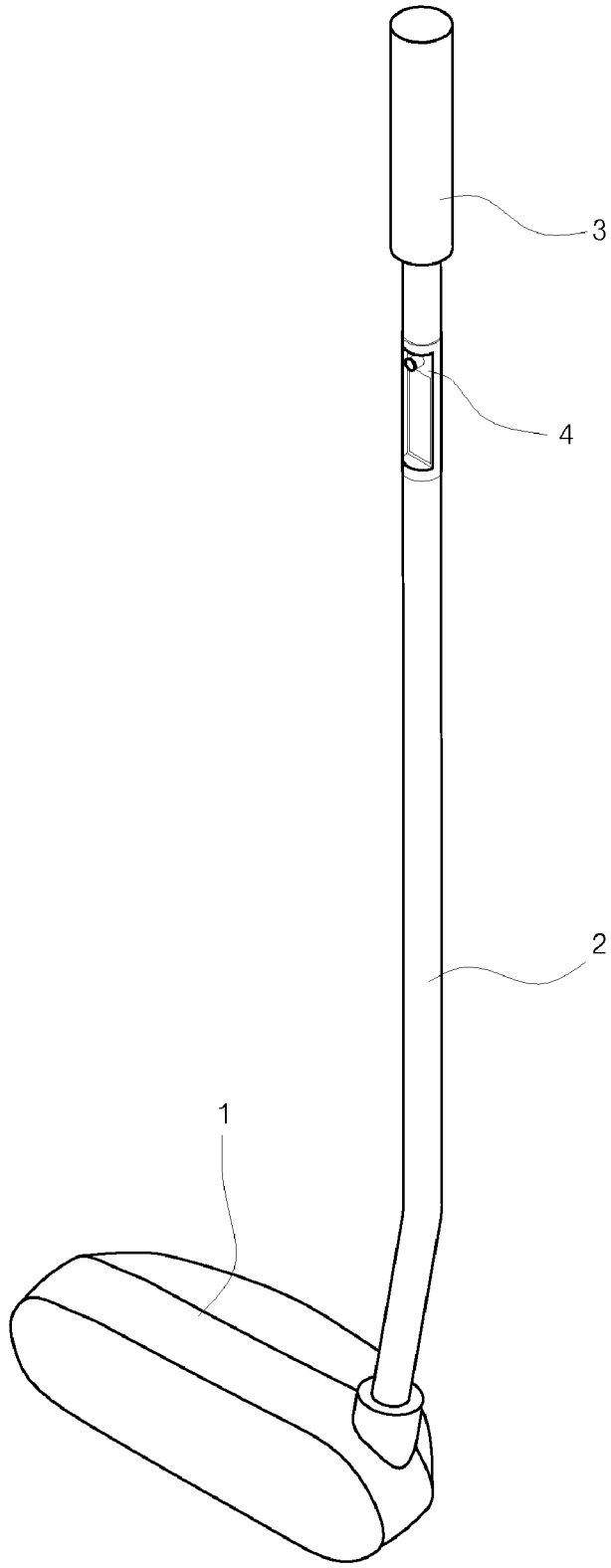
FIG. 2 is a perspective view depicting an external appearance of a golf putter having a function of providing putting information in accordance with a preferred embodiment of the present invention.

FIG. 2 is a perspective view depicting an external appearance of a golf putter having a function of providing putting information in accordance with a preferred embodiment of the present invention. The putter depicted in FIG. 2 comprises a head 1, a shaft 2 and a grip 3, like an ordinary one, and further includes a putting information providing apparatus 4 formed in the upper portion of the shaft 2.

Figure 3:
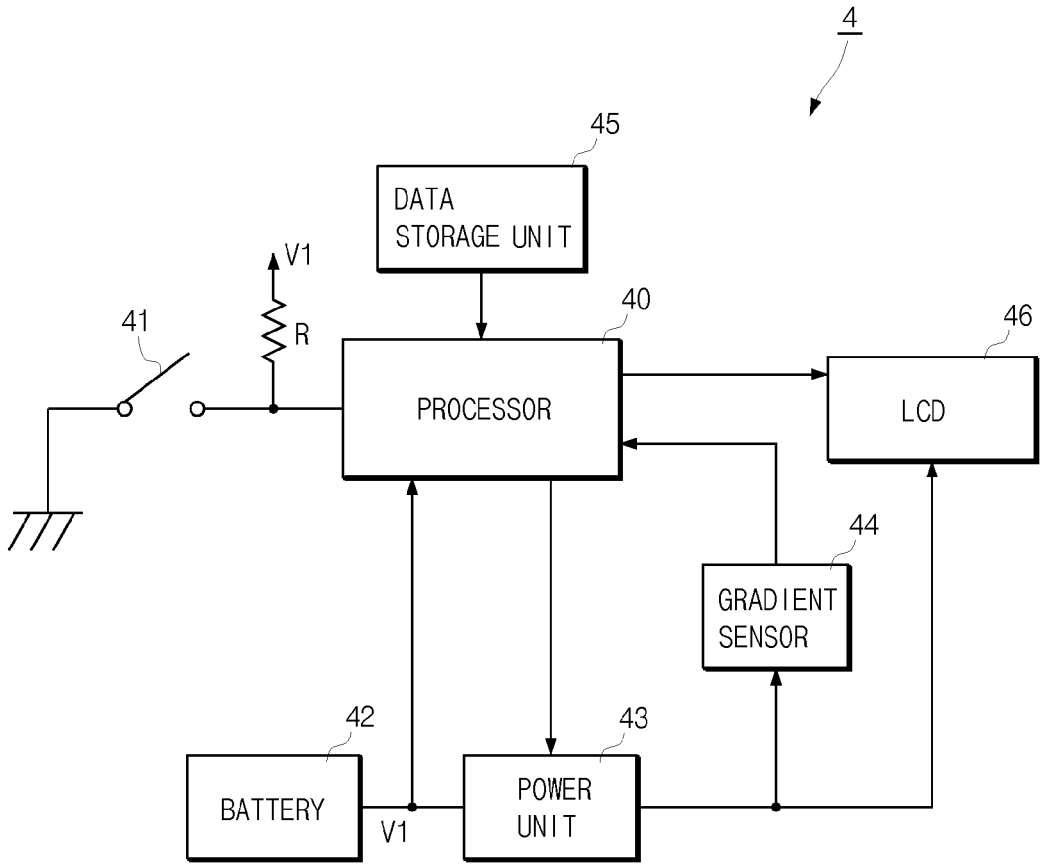
FIG. 3 is a block diagram showing an internal circuit configuration of the putting information providing apparatus 4 of FIG. 2.

FIG. 3 is a block diagram showing an internal circuit configuration of the putting information providing apparatus 4.

In the figure, the putting information providing apparatus 4 includes a processor 40 that controls the whole apparatus according to a series of program information. The operation of the process 40 will be described in detail later.

An operation switch 41 is connected to the processor 40 through a pull-up resistor R. The operation switch 41 is provided so that the player operates the apparatus 4. That is, the operation switch 41 is used to turn on and off the apparatus 4 and especially to input rough distance information from the ball GB to the hole HC to the apparatus 4.

A battery 42 is established to provide operational power to the apparatus 4. Here, a solar cell may be used instead of the battery 42 and the solar cell and the battery 42 may be used together. The operational power output from the battery 42 is supplied to the processor 40 and, at the same time, to the other circuit units through a power unit 43. The power unit 43 controls the operational power supplied to the respective circuit units according to the control of the processor 40.

A gradient sensor 44 detects a gradient of the putter based on the putter in the horizontal state. The gradient sensor 44 may be composed of an inclinometer (Model No. SCA 3000-D01 & D02 manufactured by VTI technologies, for example). Gradient data detected by the gradient sensor 44 is provided to the processor 40.

A data storage unit 45 is composed of a ROM table, for example. The putting information corresponding to the green gradient and the distance information from the golf ball GB to the hole HC is stored in the data storage unit 45. Here, as the putting information, the distance information L1 between the actual hole HC and the imaginary hole HC1 or the angle information $\alpha 2$ of the ideal putting line PL2 for the straight line PL1 between the actual hole HC and the ball GB are used as described above with reference to FIG. 1. In this embodiment, as the putting information, the distance information L1 between the actual hole HC and the imaginary hole HC1 is used.

An LCD 46 is established to display the putting information to the player. The putting information provided through the LCD 46 basically includes the distance information L1 stored in the data storage unit 45 and additionally includes the green gradient information and the distance information from the ball GB to the hole HC. Display of such additional information is not necessarily required.

Figure 4A:
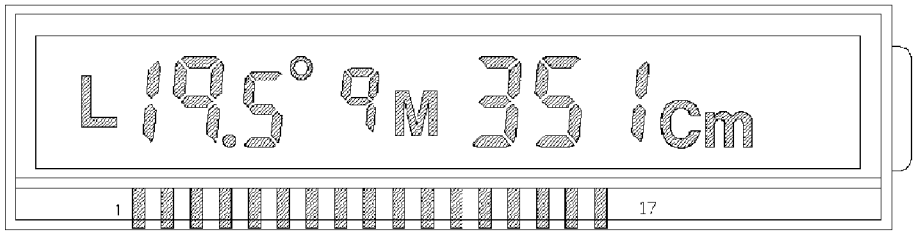
FIGS. 4A and 4B are diagrams showing display examples of the putting information provided from the putting information providing apparatus 4 of FIG. 2.
Figure 4B:
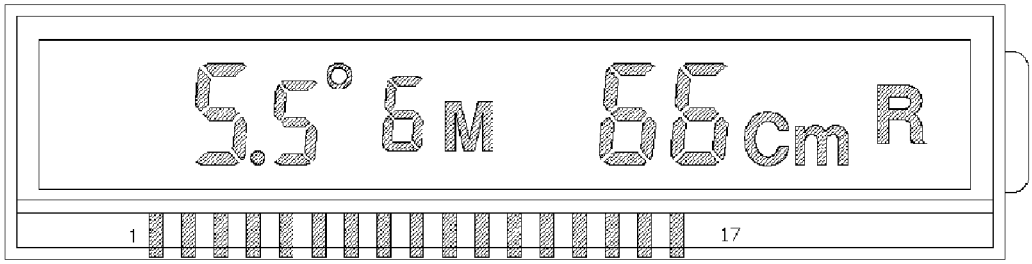

FIGS. 4A and 4B are diagrams showing examples of output screens displayed through the LCD 46. In more detail, FIG. 4A denotes that the left side of the green is higher than the right side based on the player, the gradient is 19.5°, the distance from the ball GB to the hole HC is 9 meters, and the distance from the actual hole HC to the imaginary hole HC1 is 351 cm. Moreover, FIG. 4B shows that the right side of the green is higher than the left side based on the player, the gradient is 5.5°, the distance from the ball GB to the hole HC is 6 meters, and the distance from the actual hole HC to the imaginary hole HC1 is 66 cm.

Figure 5:
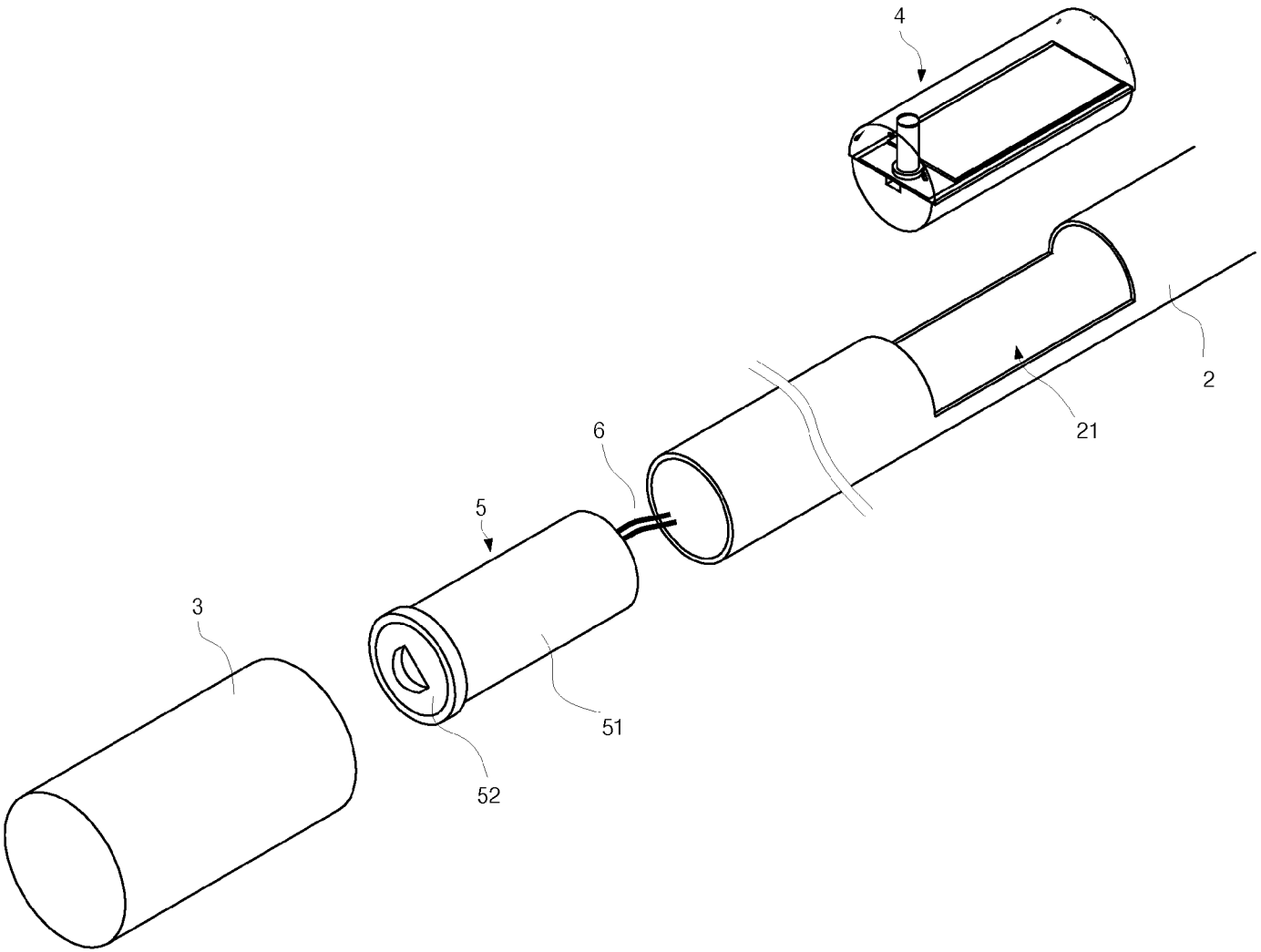
FIG. 5 is an exploded perspective view depicting main elements of the golf putter having a function of providing putting information in accordance with the present invention.

FIG. 5 is an exploded perspective view depicting main elements of the golf putter having a function of providing putting information in accordance with the present invention. A receiving portion 21 in which the putting information providing apparatus 4 is received is formed at a predetermined position of the shaft 2, and a battery receptacle 5 is inserted in the upper portion of the shaft 2. The battery receptacle 5 includes a cylindrical body 51 and a cover 52 to be opened and closed. Moreover, the body 51 has a stopper formed along the outer circumferential surface of the upper portion thereof so that the battery receptacle 5 is placed on the top surface of the shaft 2. A battery is received in the battery receptacle 5 and electrically connected to the putting information providing apparatus 4 through a wire 6. A grip 3 covers the shaft 2 in which the battery receptacle 5 inserted.

Figure 6:
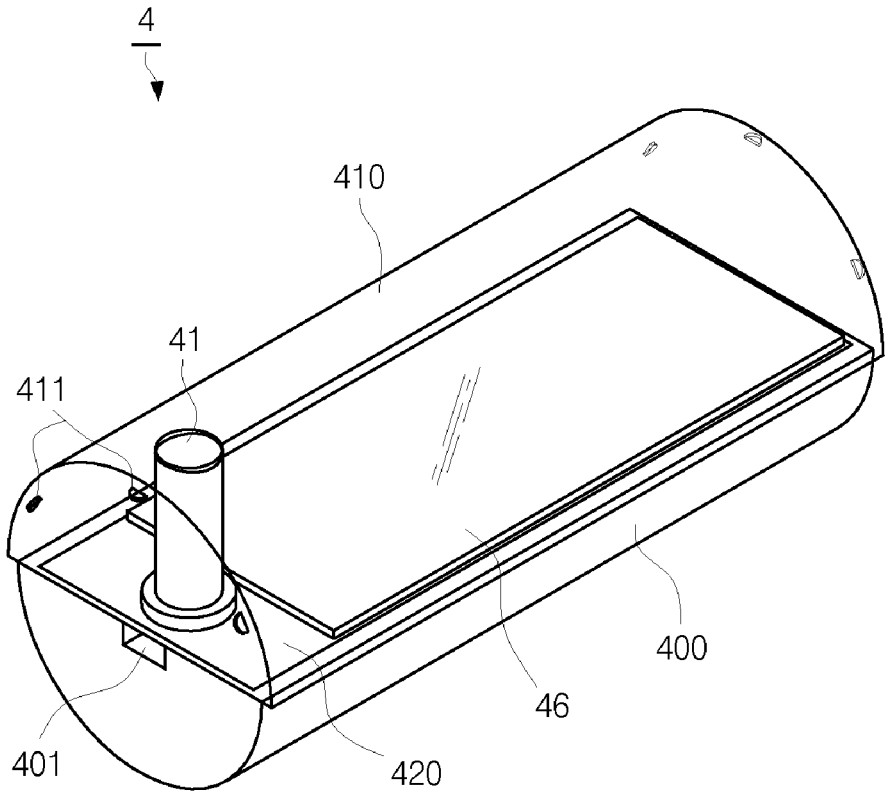
FIG. 6 is a perspective view depicting an external appearance of the putting information providing apparatus 4 of FIG. 5.
Figure 7:
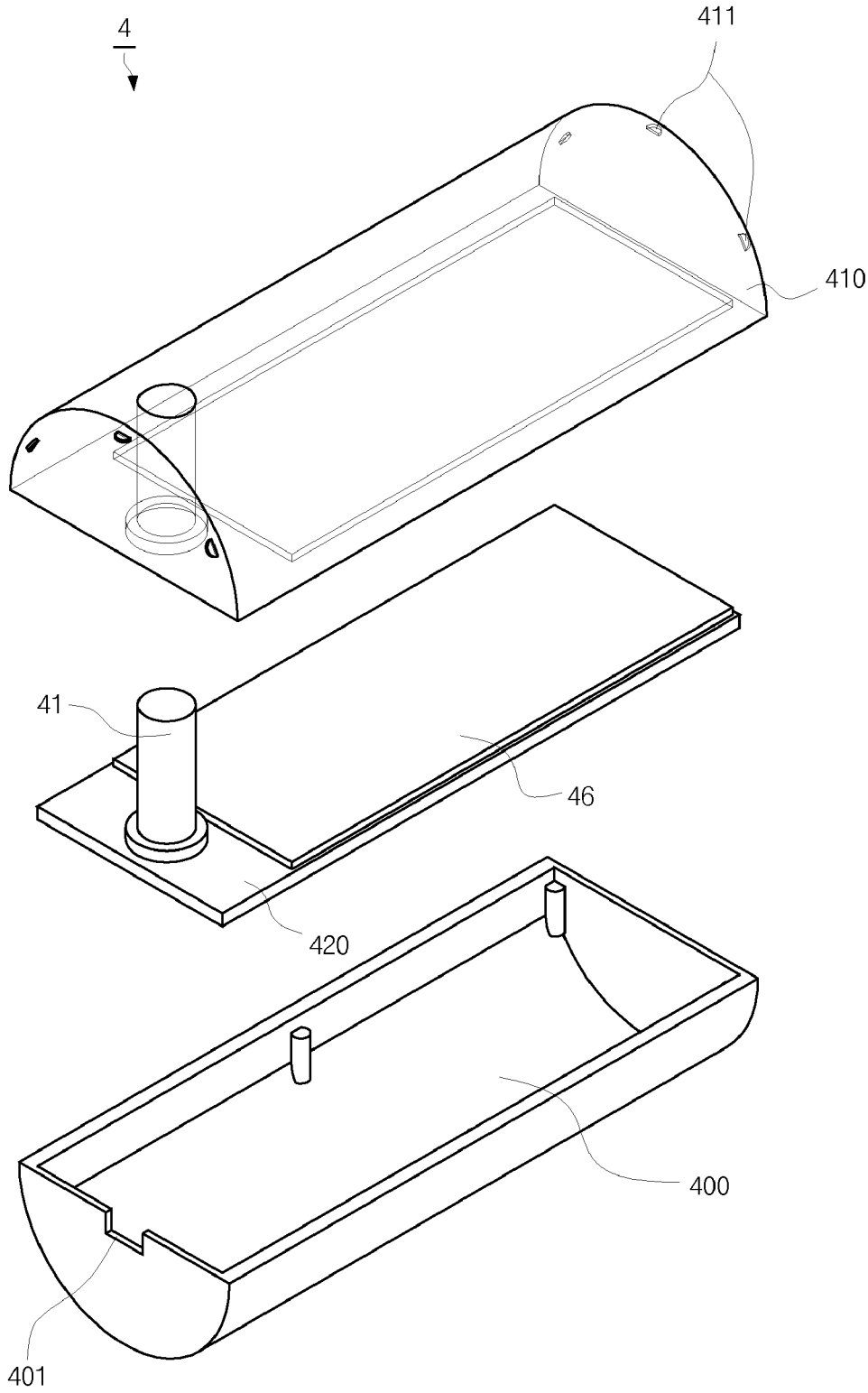
FIG. 7 is an exploded perspective view of the putting information providing apparatus 4 of FIGS. 5 and 6.

FIG. 6 is a perspective view depicting an external appearance of the information providing apparatus 4, and FIG. 7 is an exploded perspective view thereof.

The putting information providing apparatus 4 includes a lower cover 400 of which section is formed in a semicircular shape, and an upper cover 410 having the same sectional shape as the lower cover 400. The appearance of the apparatus 4 forms a cylindrical shape when the lower and upper covers 400 and 410 are connected with each other. Here, the cylinder thus connected has a diameter equivalent to that of the shaft 2.

A substrate 420 is placed on the lower cover 400. The LCD 46 is established on the top surface of the substrate 420, and the operation switch 41 is protrudingly arranged on one side surface of the LCD 46. Moreover, the circuit units such as the processor 40, power unit 43, gradient sensor 44 and data storage unit 45, etc. as described with reference to FIG. 3 are mounted on the rear surface of the substrate 420. Furthermore, a connecting hole 401 for electrically connecting wires from the battery is established on one side of the lower cover 400. An electrical connector is arranged in the connecting hole 401, if necessary, and such a connector is electrically connected to wires on the substrate 420. In addition, a solar cell is mounted on the substrate 420, if necessary.

The upper cover 410 is established on the lower cover 400 where the substrate 420 is placed. Here, the upper cover 410 is preferably made of a resin of a transparent and flexible material by injection molding. A plurality of projections 411 is established on both ends of the upper cover 410. Such projections 411 are provided so that the putting information providing apparatus 4 is not readily separated from the shaft 2 after being inserted and connected to the shaft 2.

Although not depicted in detail in the figures, after establishing the putting information providing apparatus 4 in the receiving portion 21 of the shaft 2, the outside of the shaft 2 is taped using a tape made of a transparent material, thus firmly fixing the putting information providing apparatus 4 to the shaft 2.

Subsequently, the process of performing a putting stroke using the putter as described above will be described with reference to FIG. 8.

When a golf ball lands on a green after a tee shot, a player performs a putting stroke using a putter. At the time, the player can obtain appropriate putting information from the putter in accordance with the present invention.

First, the player sets the putting information providing apparatus 4 to an operational state by pressing the operation switch 41 over a predetermined time. If the apparatus 4 is turned on as the operation switch 41 is operated over a predetermined time, the processor 40 drives the power unit 43 to supply operational power to the respective circuit units, thus setting the respective circuit units to an operational state.

Next, the player roughly determines a distance from a golf ball GB to a hole HC and presses the operation switch 41 as much as the number of times corresponding to the distance, thus inputting distance information to the putting information providing apparatus 4. For example, if the distance from the ball GB to the hole HC is 3 meters, the player presses the operation switch 41 three times and, if it is 5 meters, the player presses the operation switch 41 five times. If the distance information thus input exceeds an actual distance, that is, if the operation switch 41 is pressed four times while the distance from the ball GB to the hole HC is 3 meters, the apparatus 4 is turned off and on again using the operational switch 4 to re-input the distance information. Such distance information input method is to use a single operation switch and, if a plurality of operation switch is provided, it is possible to adopt a more effective input method than the single operation switch. Moreover, although the input distance value is increased by 1 meter at each time when the operation switch is pressed in the present embodiment, the increase unit is not limited to a specific value.

Figure 8:
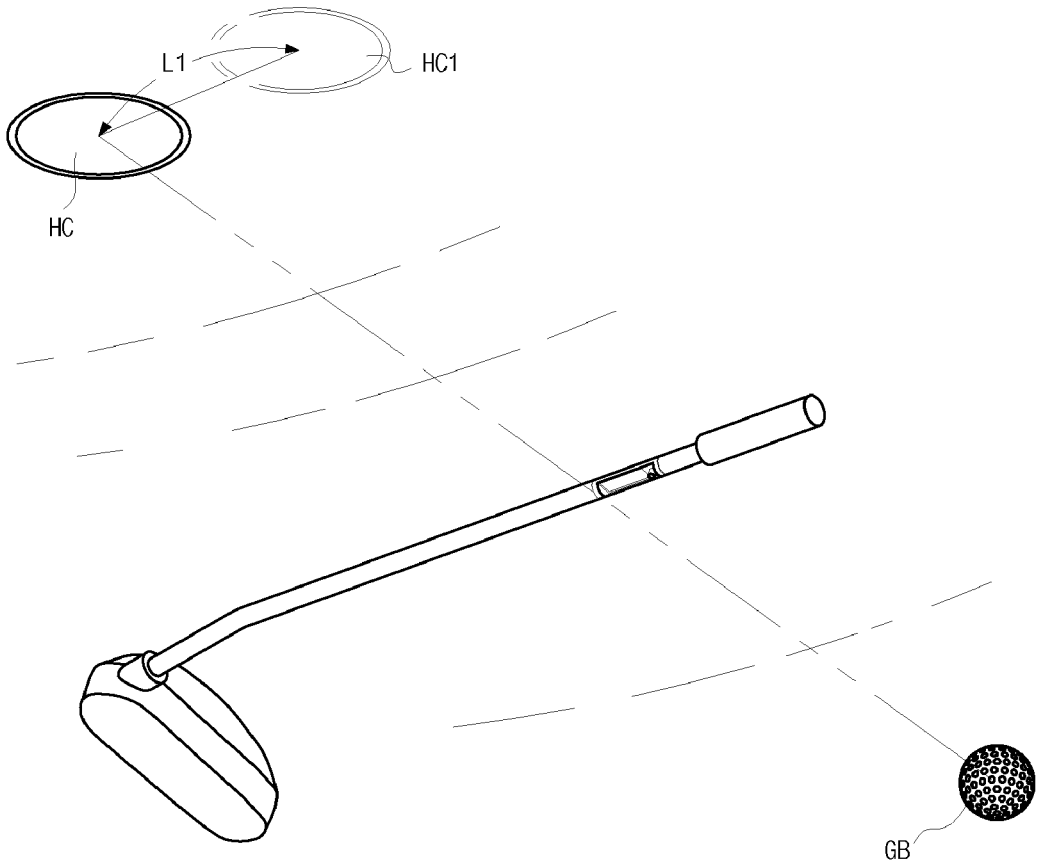
FIG. 8 is a diagram illustrating a method of using a golf putter having a function of providing putting information in accordance with the present invention.

After inputting the distance information as described above, the player lays the putter on the green between the golf ball GB and the hole HC in the perpendicular direction. That is, the shaft of the putter is arranged perpendicularly to a straight line connecting the ball GB to the hole HC as depicted in FIG. 8.

Referring back to FIG. 3, the processor 40 counts the number that the operation switch 41 is operated to determine the same as distance information from the ball GB to the hole HC and displays the distance information thus input on the LCD 46. Moreover, the processor 40 displays gradient information input from the gradient sensor 44 on the LCD 46 and further reads distance information L1 between the actual hole HC and an imaginary hole HC1 from the data storage unit 45 based on the input distance information and gradient information. And the processor 40 displays the distance information L1 on the LCD 46.

Such distance information display is repeatedly carried out at each time when the distance information that the player input is varied or when the gradient information input from the gradient sensor is changed.

Moreover, the processor 40 turns off the whole operation of the apparatus 4 through the power unit 43 to be in an idle mode, if the operation switch 41 is operated in an on-state over a predetermined time or if there is no change in the input information over a predetermined time.

In the above-described embodiment, the player can obtain position information of an imaginary hole HC1 corresponding to an ideal putting line in a simple manner that the player inputs a rough distance from the ball GB to the hole HC using the operation switch 41 established in the putter and then lays the putter on the green between the ball GB and the hole HC in the perpendicular direction. Accordingly, the player can perform a putting stroke relatively readily and accurately.

As above, preferred embodiments of the present invention have been described and illustrated, however, the present invention is not limited thereto, rather, it should be understood that various modifications and variations of the present invention can be made thereto by those skilled in the art without departing from the spirit and the technical scope of the present invention.

For example, the preferred embodiments have been described as for the method for providing the putting information based on the green gradient information and the distance information from the golf ball GB to the golf hole cup HC. However, it is possible to realize a putter in accordance with the present invention that can provide more accurate putting information based on the other green states that affect the putting process such as whether the green is slippery or not, whether the green is wet or not, etc.

As described above, the present invention provides a golf putter that determines the state of a putting green and provides putting information based on the state of the putting green.

What is claimed is:

1. A golf putter including a head, a shaft and a grip and used for a putting stroke, the golf putter having a function of providing putting information and comprising:

a putting information providing apparatus fixedly into a predetermined position of the shaft and providing putting information to a golfer; and a battery receptacle inserted and fixed to one end of the shaft, the putting information providing apparatus and the battery receptacle being electrically connected to each other through a wire, wherein the putting information providing apparatus includes: a lower cover and an upper cover made of a transparent material, the lower and upper cover forming a cylindrical shape when being connected to each other, wherein a substrate including an LCD, through which putting information is displayed, and an operation switch, through which distance information from a golf ball to a hole is input, is established on the upper portion of the lower cover; and wherein a circuit means providing putting information based on green gradient information and distance information from the golf ball to an actual hole which corresponds to a degree that the green is tilted in the perpendicular direction with respect to a straight line connecting the hole and the golf ball, is provided on the rear portion of the substrate, and wherein the circuit means comprises: a gradient sensor providing gradient information corresponding to a tilted state when the putter is laid on a horizontal surface; a data storage means storing position information on an imaginary hole against an actual hole based on the distance information and the gradient information; and a control means reading the position information of the imaginary hole from the data storage means based on the distance information and the gradient information and outputting the position information of the imaginary hole through a display means.

2. The golf putter having a function of providing putting information as recited in claim 1, wherein a plurality of projections is formed on both ends of the upper cover.

3. The golf putter having a function of providing putting information as recited in claim 1, wherein the putting information includes distance information between the actual hole and the imaginary hole.

4. The golf putter having a function of providing putting information as recited in claim 1, wherein the putting information includes angle information on an ideal putting line connecting a straight line between the ball and the imaginary hole against a straight line between the ball and the actual hole.

5. The golf putter having a function of providing putting information as recited in claim 1, wherein the putting information providing apparatus further comprises a solar cell providing operational power to the apparatus using input light.

* * * * *